US007185838B2

(12) United States Patent
Mullebrouck et al.

(10) Patent No.: US 7,185,838 B2
(45) Date of Patent: Mar. 6, 2007

(54) SPOOL FILLED WITH MULTIPLE ELONGATED ELEMENTS WOUND CLOSELY TOGETHER

(75) Inventors: Rik Mullebrouck, Rekkem (BE); Luc Sabbe, Deerlijk (BE); Stijn Vanneste, Ingelmunster (BE)

(73) Assignee: NV Bekaert SA, Zwevegem (BE)

( * ) Notice: Subject to any disclaimer, the term of this patent is extended or adjusted under 35 U.S.C. 154(b) by 0 days.

(21) Appl. No.: 10/507,503

(22) PCT Filed: Dec. 3, 2002

(86) PCT No.: PCT/EP02/13688

§ 371 (c)(1),
(2), (4) Date: Sep. 13, 2004

(87) PCT Pub. No.: WO03/076321

PCT Pub. Date: Sep. 18, 2003

(65) Prior Publication Data

US 2005/0139706 A1 Jun. 30, 2005

(30) Foreign Application Priority Data

Mar. 13, 2002 (EP) ..... 02100243

(51) Int. Cl.
*B65H 55/04* (2006.01)

(52) U.S. Cl. ..... 242/166; 242/472.8; 242/176

(58) Field of Classification Search ..... 242/FOR. 110, 242/166, 472.8, 174, 167, 176, 178; 57/204, 57/236, 293, 314

See application file for complete search history.

(56) References Cited

U.S. PATENT DOCUMENTS

| | | | | |
|---|---|---|---|---|
| 2,187,841 | A * | 1/1940 | Pierce | 242/472.8 |
| 4,830,647 | A * | 5/1989 | Watabe | 65/453 |
| 2006/0196984 | A1* | 9/2006 | Higeta | 242/176 |

FOREIGN PATENT DOCUMENTS

| | | | |
|---|---|---|---|
| EP | 0 113 671 | B1 | 7/1987 |
| EP | 0 299 506 | B1 | 3/1992 |
| EP | 0 780 333 | A1 | 6/1997 |
| GB | 1 163 983 | | 9/1969 |
| GB | 1163983 | A * | 9/1969 |
| JP | 04308166 | A * | 10/1992 |

* cited by examiner

*Primary Examiner*—Patrick Mackey
*Assistant Examiner*—William E. Dondero
(74) *Attorney, Agent, or Firm*—Foley & Lardner LLP

(57) ABSTRACT

A spool filled with two or more elongated elements such as steel cords wound in parallel and in several windings upon the spool. The distances between two neighboring elongated elements, as measured along a line parallel to the axis of the spool, is not more than 10 mm along 90% of the length of each elongated element.

16 Claims, 2 Drawing Sheets

SPOOL FILLED WITH MULTIPLE ELONGATED ELEMENTS WOUND CLOSELY TOGETHER

FIELD OF THE INVENTION

The present invention relates to a spool filled with two or more elongated elements wound in parallel and in several windings upon the spool. The present invention also relates to a method of providing such a spool. The terms 'elongated elements' refer to elements the longitudinal dimension of which is more than hundred times larger than the cross-sectional dimensions. Common examples of elongated elements are round or flat steel wires, steel cords, textile yarns, copper strands, . . .

BACKGROUND OF THE INVENTION

Assemblies and apparatus for winding a plurality of elongated elements such as wires, cables or cords on one single spool are known in the art.

As a matter of example, when manufacturing composites of rubber with steel cord, such as tires, the steel cords are very often drawn from a creel, which comprises a large number of spools, e.g. 20 to 150 spools in some embodiments and e.g. 500 to 1000 spools in other embodiments. The great number of steel cords is then guided in parallel in order to be inserted between two layers of rubber. A drawback of such a system is that it takes a lot of time to replace the empty spools by filled spools. Using spools with multiple winding, i.e. where a plurality of steel cords is wound upon one spool, reduces the number of spools in a creel and increases the flexibility of the use of such a creel.

However, the simultaneous unwinding of a plurality of elongated elements from such a single spool, may cause difficulties and the subsequent parallel processing of the plurality of elongated elements may lead to an unacceptable degree of fractures and processability problems.

The unwinding difficulties and the processability problems and fractures during the subsequent treatment may be due to a variation in diameter of the elongated elements during their winding, or may be due to the fact that elongated elements become entangled during their winding, or may be due to the fact that the elongated elements, although wound at the same time on the same spool, take different lengths on the spool. Other difficulties during the unwinding operations are due to different tensions in the individual elongated elements during the winding operation.

GB-B-1 163 983 discloses a method for winding a plurality of elongated elements on one single spool whereby it is aimed at keeping the winding lengths of the elongated elements substantially equal to each other despite some variations in diameter of the elongated element. The solution used to obtain substantially the same lengths is to increase the tension in elongated elements with an increased diameter in order to reduce the winding diameter and to decrease the tension in elongated elements with a decreased diameter in order to increase the winding diameter. A separation comb is mounted upstream the winding spool in order to avoid disentanglement of the neighboring elongated elements.

EP-A-0 780 333 discloses an assembly for winding multiple elongated elements on a spool, where the tensions in the elongated elements are kept substantially constant and equal. In order to obtain constant and equal tensions, the assembly comprises following parts:

- a set of independently driveable capstans, one for each individual elongated element to be wound;

- a single spool where the plurality of elongated elements are to be wound;
- first monitoring means for measuring the tensions of each individual elongated element of a subgroup of the plurality of elongated elements;
- first control means for steering individually the revolution speed of the capstans driving the elongated elements of the subgroup such that said tensions remain substantially constant and substantially equal to each other.

Before their winding on the spool, a comb is used to prevent the wires from entangling with each other and from jumping over each other.

So the prior art has provided solutions both for keeping the lengths equal and the tensions constant in the elongated elements to be wound.

Despite these solutions problems are still experienced in determined circumstances when unwinding the plurality of elongated elements at the same time. More particularly, when unwinding, some of the elongated elements show unacceptable large sags. These sags may lead to entanglement with the neighboring elements or to wear or pollution of the sagged elements when these elements drag over the floor of the unwinding shop. Still another problem is that the ultimate product, e.g. a rubber strip with the elongated elements may show some unacceptable wrinkles.

SUMMARY OF THE INVENTION

It is an object of the present invention to avoid the drawbacks of the prior art.

It is another object of the present invention to minimize unwinding problems.

It is yet another object of the present invention to minimize sags during the unwinding of the plurality of elongated elements.

It is still another object of the present invention to avoid wrinkles in the ultimate product.

According to a first aspect of the present invention there is provided a spool filled with two or more elongated elements wound in parallel and in several windings upon the spool. The distance between two neighboring elongated elements, as measured along a line parallel to the axis of the spool, is not more than 10 mm, preferably not more than 8 mm, e.g. not more than 5 mm, along 90% of the length of each elongated element.

Indeed the inventors have experienced that the distance between the neighboring elongated elements wound on the spool is a critical parameter. It does not only suffice to wind the elongated elements under substantially equal tensions and to wind the elongated elements with substantially equal lengths upon the spool, the elongated elements have also to be wound as close as possible to each other without becoming entangled. As will be explained hereinafter, the greater the distance between two neighboring elongated elements, the greater the danger for tension differences in the unwinding elongated elements—even if the elongated elements have been wound under equal tensions and with equal lengths. The greater the tension differences in the unwinding elongated elements the greater the danger for sags in one or more of the elongated elements and the greater the danger for wrinkles in the ultimate product.

The elongated elements may be steel elements such as steel wires or steel cords.

In a particular embodiment of the invention, there is provided a spool wherein one of the steel cords comprises steel filaments, a majority of which is twisted in a first twist direction, and wherein another of the steel cords also comprises steel filaments, a majority of which is twisted in a second twist direction. The second twist direction is opposite to the first twist direction.

Preferably the spool comprises two steel cords wound upon the spool. One steel cord is mainly twisted in an S-direction and the other steel cord is mainly twisted in a Z-direction.

According to a second aspect of the present invention, there is provided a method of minimizing sags when unwinding multiple elongated elements from one single spool. The method comprises the following steps:

a) providing a spool;

b) winding multiple elongated elements in parallel and in several windings upon the spool so that that the distance between two neighboring elongated elements, as measured along a line parallel to the axis of the spool, is not more than 10 mm along 90% of the length of each elongated element.

In a preferable embodiment of the method the multiple elongated elements are guided on a common pulley just upstream the spool in order to reduce as much as possible the distance s between two neighboring elongated elements on the spool. The common pulley is located as close as possible to the spool.

Most preferably the multiple elongated elements are kept separate from each other upstream the common pulley in order to avoid that the elongated elements would entangle with each other.

The common pulley preferably has a flat groove and most preferably the width of this groove is somewhat greater than the sum of the diameters of the multiple elongated elements. This gives the best results with respect to minimizing the distance s while still avoiding the entanglement between two neighboring elongated elements.

BRIEF DESCRIPTION OF THE DRAWINGS

The invention will now be described into more detail with reference to the accompanying drawings wherein.

DESCRIPTION OF THE PREFERRED EMBODIMENTS OF THE INVENTION

Figure 1:
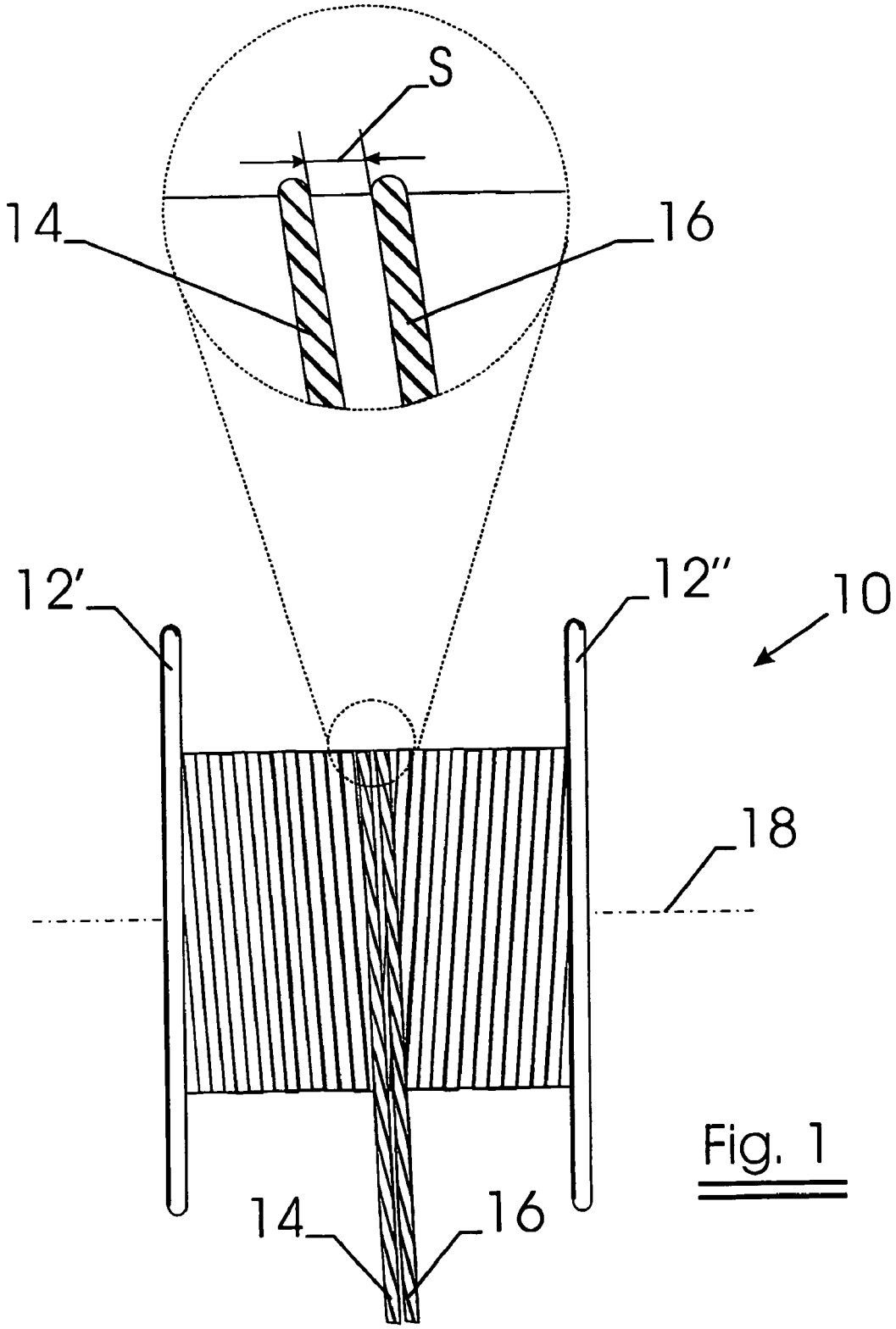
FIG. 1 shows a spool according to a first embodiment of the present invention.

FIG. 1 shows a spool 10 according to a first embodiment of the first aspect of the present invention. The spool 10 is provided with two flanges 12' and 12". Two steel cords 14 and 16, both twisted in S-direction, are wound in parallel and adjacent to each other on spool 10. The distance s, as measured along a line parallel to the axis 18 of spool 10, is less than 5 mm.

Figure 2:
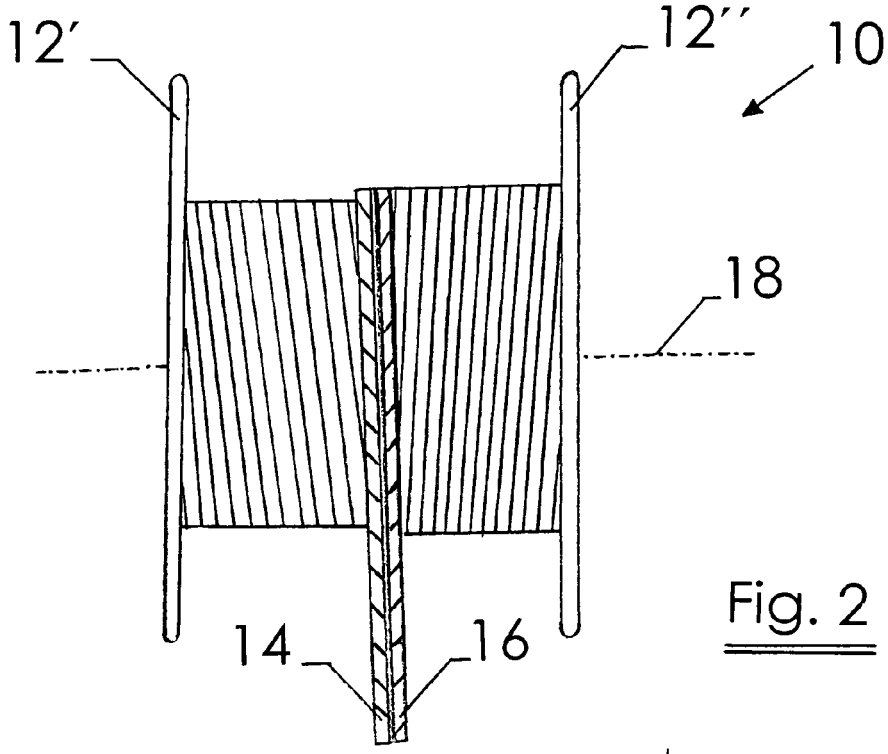
FIG. 2 shows a spool according to a second and particular embodiment of the present invention.

FIG. 2 shows a spool 10 according to a particular and second embodiment of the first aspect of the present invention. The spool 10 is provided with two flanges 12' and 12". A steel cord 14, twisted in S-direction, and a steel cord 16, twisted in Z-direction, are wound in parallel and adjacent to each other on spool 10. The distance s, as measured along a line parallel to the axis 18 of spool 10, is less than 5 mm. When using spools according to this particular embodiment of the invention on a creel in the field of rubber tires, an S-cord and a Z-cord will lie, one adjacent to the other in a composite ply rubber-steel cord. If all the spools on the creel will be spools according to the invention, there will be an equal number of S-cords and Z-cords on average over the whole composite rubber-steel cord ply. S-cords will alternate on average with Z-cords over the whole composite ply. In such a configuration it is likely that any residual torsions present on S-cords may compensate on average any residual torsions present on Z-cords so that eventually cut composite strips rubber-steel cord do not exhibit curling. Within the context of the present invention, the terms "residual torsions" are defined as follows: if one end of a specified length of cord is allowed to turn freely, the number of residual torsions is equal to the number of revolutions counted. An imbalance of residual torsions over the totality of steel cords within one composite strip rubber-steel cord is known as the main cause of curling. Avoiding this imbalance reduces the risk for curling. And, as explained above, avoidance of curling may facilitate the automated handling of the strips. In such configuration it is sufficient that the steel cords present in the cut strips have on average no residual torsions. As a result it is no longer required to fine-tune the amount of residual torsions present on each single steel cord during its twisting step. This may considerably reduce the auxiliary equipment required, more particularly, the automatic torsion control may be cancelled.

Figure 3:
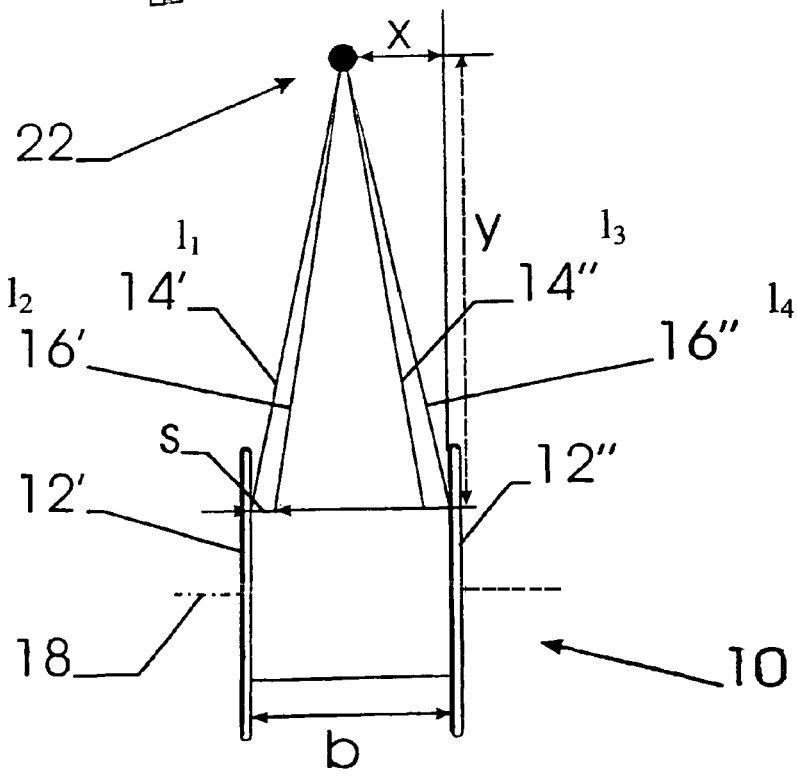
FIG. 3 gives a schematic drawing explaining the working of the present invention.

FIG. 3 explains the basic working of the present invention. Spool 10 is filled with two steel cords 14, 16. There is a distance s present between the two steel cords 14 and 16, measured along a line parallel to the axis 18 of the spool 10. The two steel cords 14, 16 are wound from spool 10 and are guided through one single fixed hole 22. Steel cords 14' and 16' show the situation at the left flange 12' and steel cords 14" and 16" show the situation at the right flange 12".

For the sake of the current calculations, the distance s is supposed to remain constant during the unwinding process.

Also for the sake of calculations, the hole 22 is supposed to be at a distance of y=3000 mm from the spool 10, and at x=0 mm from the extension of right flange 12".

The spool width b is equal to 153 mm.

It is further supposed that the steel cord is of a 2×0.30 type, so that the cross-section A is equal to 0.141372 $mm^2$.

$l_1$ is the length of the unwound cord 14', $l_2$ the length of the unwound cord 16', $l_3$ the length of the unwound cord 14" and $l_4$ the length of the unwound cord 16".

With the above assumptions, at with a value of intercord distance s equal to 10 mm, we obtain following values for the various lengths $l_1$, $l_2$, $l_3$, and $l_4$:

$$l_1=\sqrt{y^2+(b-x)^2}=3003{,}899 \text{ mm}$$

$$l_2=\sqrt{y_2+(b-x-s)^2}=3003{,}406 \text{ mm}$$

$$l_3=\sqrt{y^2+(x-s)^2}=3000{,}017 \text{ mm}$$

$$l_4=\sqrt{y^2+x^2}=3000{,}000 \text{ mm}$$

The difference of the length difference, i.e. the change in length difference between the situation at the left flange 12' and the length difference at the right flange 12" is:

$$(l_1-l_2)-(l_3-l_4)=0{,}476067 \text{ mm}$$

Such a change in length difference results in a change in tension difference of $$\Delta\sigma \approx \frac{(1_1-1_2)-(1_3-1_4)*E*A}{y}=4{,}4868 \text{ Newton}$$

With an intercord distance s different from 0 mm, the length difference between the unwound steel cords 14 and 16 changes continuously during the unwinding operation, which results in changing tension differences in the unwound steel cords 14 and 16.

This change in tension difference is dependent upon the distance s and increases as the distance s increases, as may be derived from the following table.

TABLE tension difference in function of distance s

| s [mm] | Δσ (Newton) |
|---|---|
| 0 | 0 |
| 0.5 | 0.239236 |
| 1 | 0.476904 |
| 1.5 | 0.713005 |
| 2 | 0.947537 |
| 2.5 | 1.180502 |
| 3 | 1.411899 |
| 3.5 | 1.641728 |
| 4 | 1.86999 |
| 4.5 | 2.096683 |
| 5 | 2.321809 |
| 5.5 | 2.545366 |
| 6 | 2.767356 |
| 6.5 | 2.987777 |
| 7 | 3.206631 |
| 7.5 | 3.423917 |
| 8 | 3.639634 |
| 8.5 | 3.853784 |
| 9 | 4.066365 |
| 9.5 | 4.277379 |
| 10 | 4.486824 |
| 10.5 | 4.694701 |
| 11 | 4.901 |

Dependent upon the unwinding tension applied to the spool, which may vary from 400 gram (=3.924 Newton) to 3 kg (=29.43 Newton), considerable sags up to 0.5 m and higher may be registered. Sags occur each time the tension in one elongated element becomes zero. More exactly, when the difference between the unwinding tension applied to the spool (this is the sum of the unwinding tensions of the individual elongated elements) and the tension difference between the individual elongated elements becomes smaller than zero, one of the elongated elements will form a sag.

The above simulation and calculation shows that it is important to keep the distance s between the neighboring elongated elements as small as possible.

The underlying layer consisting of the same type of elongated elements, the underlying layer is rough. So it is not always possible to keep the distance s constant during winding. Nevertheless measures should be taken to keep the distance between the neighboring elongated elements as small as possible.

The invention claimed is:

1. A spool comprising two or more elongated steel elements wound in parallel and in several windings upon said spool, wherein several windings wound next to each other build a layer, wherein said two or more elongated steel elements alternate with each other in each layer, wherein the distance between two neighboring elongated steel elements, as measured along a line parallel to the axis of the spool, is not more than 10 mm along 90% of the length of each elongated steel element.

2. A spool according to claim 1 wherein said distance is smaller than 5 mm.

3. A spool according to claim 1 wherein said steel elements are steel wires.

4. A spool according to claim 1 wherein said steel elements are steel cords.

5. A spool according to claim 4 wherein one of said steel cords comprises steel filaments, a majority of which being twisted in a first twist direction, and wherein another of said steel cords comprises steel filaments, a majority of which being twisted in a second twist direction, said second twist direction being opposite to said first twist direction.

6. A spool according to claim 1, wherein said distance is smaller than 8 mm.

7. A spool according to claim 1, wherein the steel elements are wound on the spool so that a difference in tension between the steel elements is minimized.

8. A spool according to claim 1, wherein the steel elements are wound on the spool so that sagging of the steel elements is minimized when the steel elements are unwound from the spool.

9. A spool according to claim 1, comprising three or more elongated steel elements wound in parallel upon said spool, wherein said three or more elongated steel elements form a winding, wherein one or more windings wound next to each other build a layer, wherein said windings alternate said three or more elongated steel elements with each other in each layer.

10. A spool according to claim 1, wherein the spool comprises flanges arranged on ends of the spool.

11. A method of winding steel elements on a spool, said method comprising the following steps:

a) providing a spool;

b) winding multiple elongated steel elements in parallel and in several windings upon said spool so that the distance between two neighboring elongated steel elements, as measured along a line parallel to the axis of the spool, is not more than 10 mm along 90% of the length of each elongated steel element, wherein sagging of the steel elements is minimized during unwinding the multiple elongated steel elements from the spool.

12. A method according to claim 11 wherein said method further comprises the following step:

guiding the multiple elongated steel elements on a common pulley upstream of the spool.

13. A method according to claim 12 wherein said method further comprises the following step:

keeping the multiple elongated steel elements separate from each other upstream of said common pulley.

14. A method according to claim 13 wherein said common pulley has a flat groove.

15. A method according to claim 14 wherein said flat groove has a width being greater than the sum of the diameters of the multiple elongated steel elements.

16. A method according to claim 11, wherein said steel elements are steel cords;

wherein one of said steel cords comprises steel filaments, a majority of which being twisted in a first twist direction, and wherein another of said steel cords comprises steel filaments, a majority of which being twisted in a second twist direction, said second twist direction being opposite to said first twist direction.

* * * * *